United States Patent [19]

Nishimoto

[11] 4,018,125

[45] Apr. 19, 1977

[54] ELECTRONIC MUSICAL INSTRUMENT

[75] Inventor: Tetsuo Nishimoto, Hamamatsu, Japan

[73] Assignee: Nippon Gakki Seizo Kabushiki Kaisha, Japan

[22] Filed: Oct. 21, 1975

[21] Appl. No.: 624,496

[30] Foreign Application Priority Data

Oct. 24, 1974 Japan ..... 49-122854

[52] U.S. Cl. ..... 84/1.19; 84/1.26; 84/1.27

[51] Int. Cl.[2] ..... G10H 1/02; G10H 5/02

[58] Field of Search ..... 84/1.01, 1.03, 1.09–1.11, 84/1.13, 1.19, 1.24–1.27

[56] References Cited

UNITED STATES PATENTS

| | | | |
|---|---|---|---|
| 3,816,636 | 6/1974 | Peltz | 84/1.1 |
| 3,881,387 | 5/1975 | Kawakami | 84/1.24 |
| 3,886,836 | 6/1975 | Hiyoshi | 84/1.26 |
| 3,897,709 | 8/1975 | Hiyoshi et al. | 84/1.19 |
| 3,902,397 | 9/1975 | Morez et al. | 84/1.27 |

*Primary Examiner*—Stanley J. Witkowski
*Attorney, Agent, or Firm*—Ladas, Parry, Von Gehr, Goldsmith & Deschamps

[57] ABSTRACT

This invention provides an electronic musical instrument capable of producing plural musical tones simultaneously and also capable of controlling the pitch, tone color and volume of the musical tones in response to a player's finger touch on a key.

Transducers capable of electrically detecting the finger touch, i.e. factors including pressure and speed of depression and displacement of the key, are provided for respective keys. Analog outputs of these transducers are sampled and multiplexed in time sharing by each of channels of the number equal to a maximum number of musical tones to be produced simultaneously, and each of the multiplexed signals is held in a corresponding one of condensers provided in the respective channels. The pitch, tone color and volume are controlled in accordance with the magnitudes of voltages held in these condensers. Suitable discharging circuits are connected to these holding condensers. There are also provided means for variably controlling discharging characteristics of the discharging circuits in response to the magnitudes of the voltages held in the condensers and for varying the discharging characteristics stepwisely upon release of the key or at a desired time point thereafter.

6 Claims, 11 Drawing Figures

KEYBOARD CIRCUIT
1
KEY ASSIGNER
2
N1~N61
N1 ~ N61
EG1 ~ EG8
H1 ~ H8
NOTE VOLTAGE GEN.
3
KG1~KG61
KEY GATES
4-1 MUSICAL TONE SIGNAL GEN.
4-2
4-3
4-8
H1 EG1 Tch1
H2 EG2 Tch2
H3 EG3 Tch3
H8 EG8 Tch8
BUFFER AMP.
5
SOUND SYSTEM
6
TRANSDUCER
T1 ~ T61
IMPEDANCE CONVERSION, MULTIPLEX AND SAMPLE
7
TOUCH SIGNAL GEN.
8
Tch8 ~ Tch1
H8~H1
RELAY
9

FIG. 3
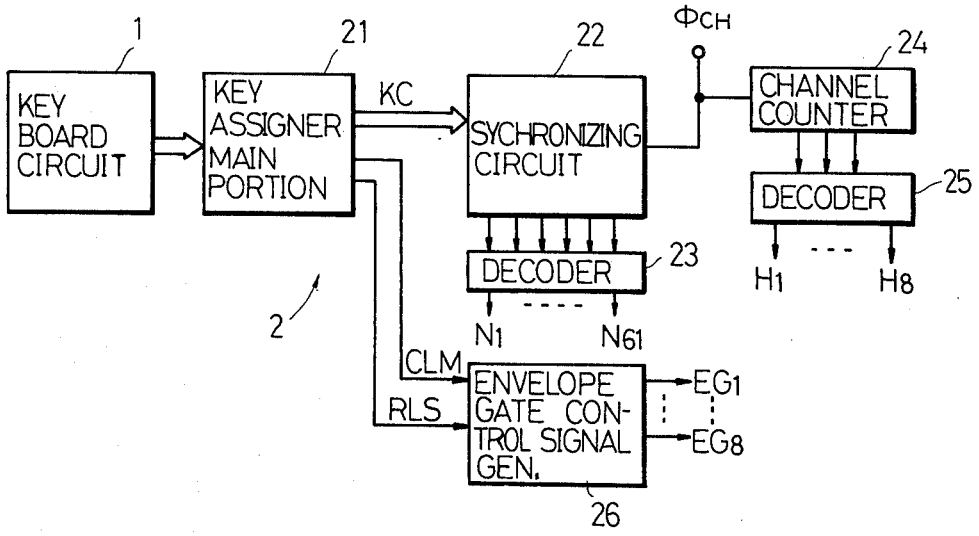
FIG. 4(a)
FIG. 4(b)
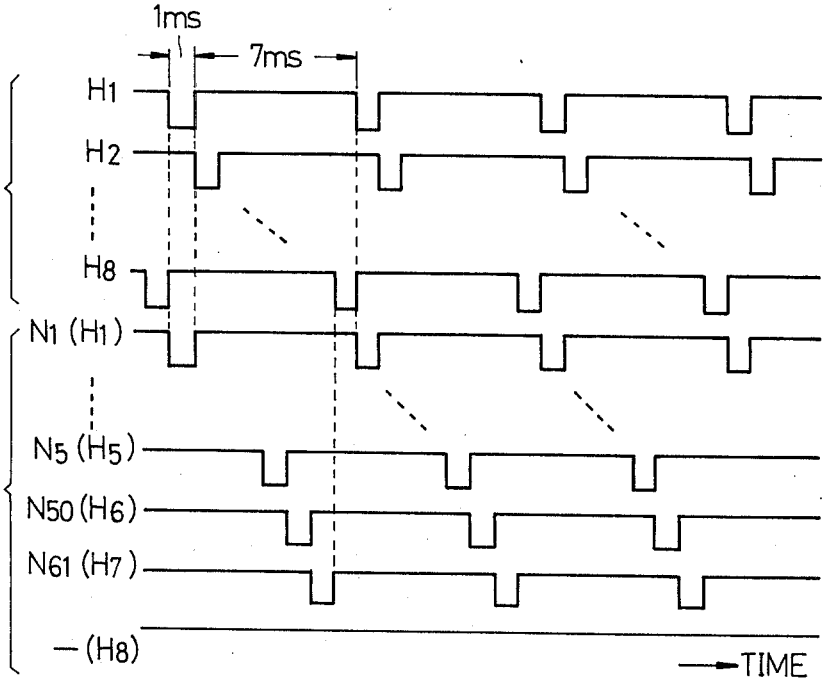

ELECTRONIC MUSICAL INSTRUMENT

BACKGROUND OF THE INVENTION

This invention relates to an electronic musical instrument and, more particularly, to an electronic musical instrument capable of producing a plurality of musical tones simultaneously and also capable of controlling the pitch, tone color and volume of the respective musical tones in response to "finger touch;" i.e., pressure applied on the keys upon depression thereof, speed of depression and displacement of the keys upon depression thereof.

A function to control musical tones in response to the finger touch (hereinafter referred to as "touch response function") and a function to control musical tones subsequent to this touch (hereinafter referred to as "after-touch control") are both desirable for electronic musical instruments because the player's feeling can be expressed in the reproduced musical tones through these functions. In the prior art electronic musical instruments capable of playing plural tones simultaneously, said touch response and after-touch control functions are performed with respect to each of the keys by providing the same number of touch response control circuits and musical tone generation systems as a total number of keys on the keyboard. This naturally necessitates a large size of apparatus and accompanying high manufacturing costs.

SUMMARY OF THE INVENTION

It is, therefore, a general object of the present invention to eliminate the above described disadvantage of the prior art musical instrument and provide an electronic musical instrument capable of performing the touch response and after-touch control functions with a very compact construction.

It is another object of the invention to provide an electronic musical instrument capable of performing touch response and after-touch controls by sampling touch detection signals each corresponding to touch on the key and delivered from transducers provided for the respective keys in a time shared multiplexing manner by each of channels of the number equal to a maximum number of musical tones to be produced simultaneously, producing touch signals of desired waveshapes by first holding the sampled signals statically in condensers provided for the respective channels and then discharging the signals through suitable time constant circuits. It will be noted that a maximum number of musical tones to be produced simultaneously is much smaller than a total number of keys provided on the keyboard and, accordingly, the size of the entire apparatus can be made extremely compact as compared with the prior art instrument in which the same number of touch response control circuits and musical tone generation circuits as that of the total number of keys is required.

These and other objects and features of the invention will become apparent from the description made hereinbelow with reference to the accompanying drawings.

BRIEF DESCRIPTION OF THE DRAWINGS

FIG. 3 is a block diagram schematically showing a key assigner employed in this embodiment.

FIGS. 4*a* and *b* are timing charts showing an example of a time sharing gate control signal.

DETAILED DESCRIPTION OF THE INVENTION

Figure 1:
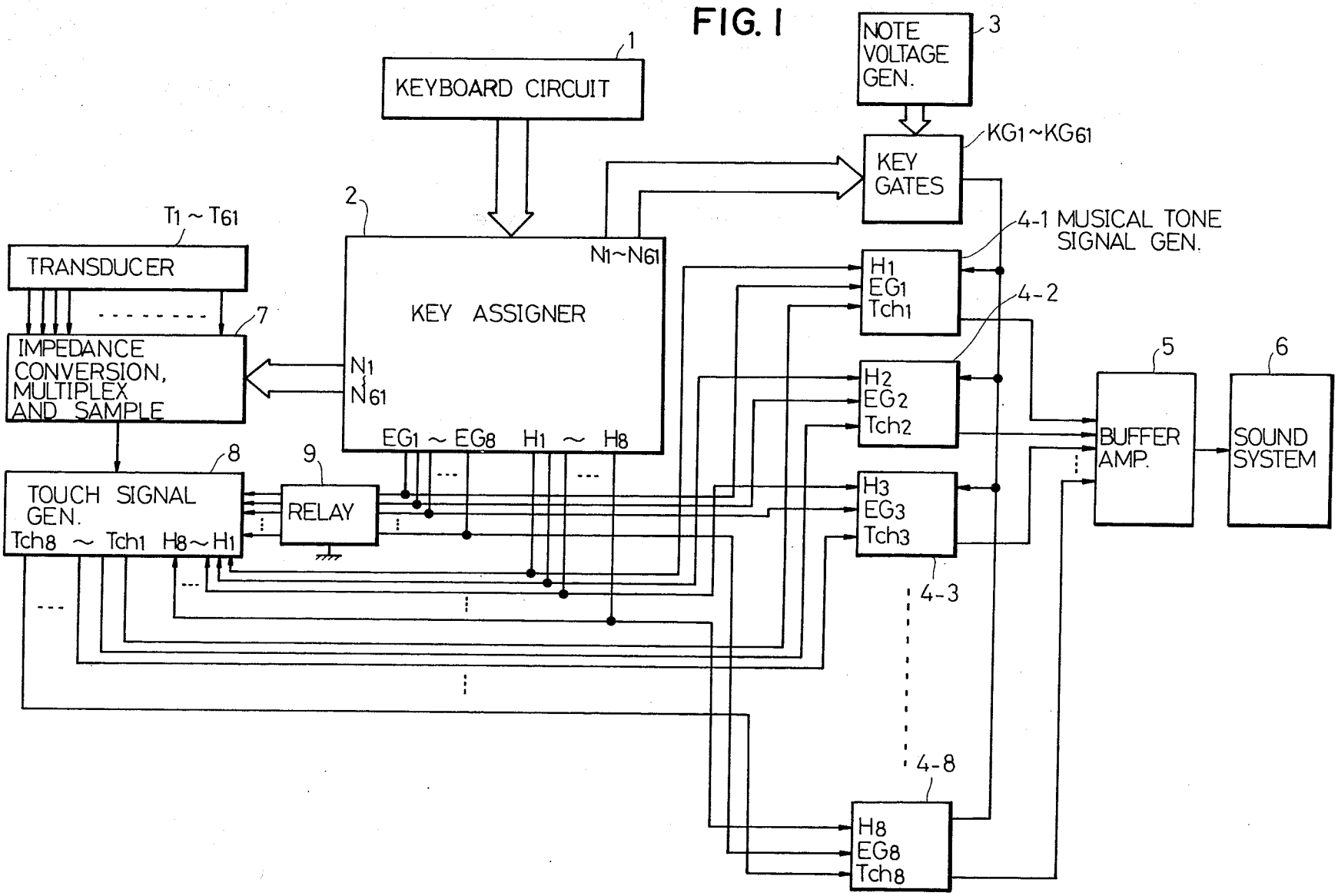
FIG. 1 is a block diagram showing an entire construction of a preferred embodiment of the electronic musical instrument according to the invention.

FIG. 1 schematically shows one preferred embodiment of the electronic musical instrument according to the invention. This embodiment is one applied to an electronic musical instrument called a music synthesizer which generates a musical tone signal having a frequency determined by a note voltage representing a depressed key and the tone signal is controlled in its pitch, tone color and volume in response to a control voltage. In order to achieve touch control with respect to each of a maximum number of tones to be produced simultaneously, the electronic musical instrument must be of a type that can produce a plurality of tones simultaneously. Such type of electronic musical instrument is disclosed in the specification of the copending U.S. Pat. application No. 601,945 filed Aug. 4, 1975 and No. 609,846 filed Sept. 2, 1975 (now U.S. Pat. No. 3,981,217), both applications being of common assignment herewith. The outline of the electronic musical instrument disclosed in the above specifications will be briefly described.

Figure 2:
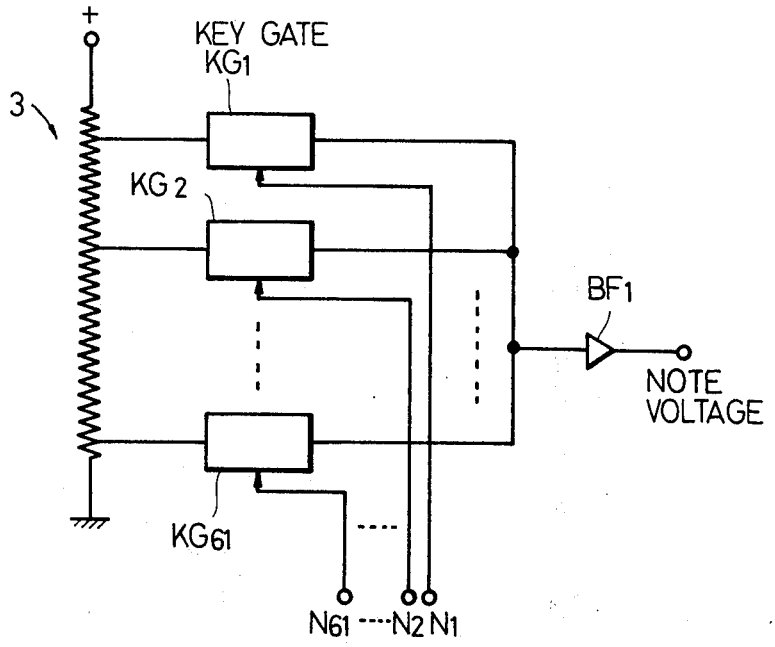
FIG. 2 is a block diagram showing a key gate circuit for sampling a note voltage provided in the circuit shown in FIG. 1.

In the drawings, a keyboard circuit 1 is provided separately from a note voltage generation circuit 3. A key assigner 2 detects ON-OFF states of respective key switches in the keyboard circuit 1 and produces, in time shared sequence, key gate control signals corresponding to the tones to be produced simultaneously among key gate control signals $N_1 - N_{61}$ (assuming that the total number of keys is 61) in accordance with the ON-OFF states of the respective key switches. The key gate control signals $N_1 - N_{61}$ are applied to gate control inputs of key gate circuits $KG_1 - KG_{61}$. As shown in FIG. 2, the note voltages representing the notes of the respective keys are obtained from respective taps of a resistance element in the note voltage generation circuit 3. The note voltages are applied to the key gate circuits $KG_1 - KG_{61}$ and sampled by the key gate control signals $N_1 - N_{61}$ in a time sharing manner. The sampled note voltages are thereafter applied to musical tone signal generation systems 4 – 1 through 4 – 8 corresponding to respective channels of the musical tones to be produced simultaneously through a buffer amplifier $BF_1$. As will be described later, the systems 4 – 1 through 4 – 8 have channel gate circuits $CG_1 - CG_8$ which are gate controlled by channel gate control signals $H_1 - H_8$ produced by the key assigner 2 in synchronization with the key gate control signals $N_1 - N_{61}$. The note voltages supplied from the key gate circits $KG_1 - KG_{61}$ are sampled by this gate control one by one in each channel time and held by each channel. Desired musical tone signals are formed in the systems 4 – 1 through 4 – 8 on the basis of these note voltages and plural tones (eight tones at the maximum) are simultaneously reproduced through a buffer amplifier 5 and a sound system 6.

Referring to FIG. 3 which shows the key assigner 2 schematically, ON-OFF information of the respective key switches in the keyboard circuit 1 obtained by scanning the key switches or by parallel detection is supplied to a main portion 21 of the key assigner 2. In response to the ON-OFF information, key code signals KC representing key switches (i.e., keys) which are ON are produced and stored in the main portion 21. The stored key code signals KC for the respective tones of the eight channels are read out in a time sharing manner. The main portion 21 detects whether a key has been newly depressed or is being depressed or has been released and causes the key code signal KC to be stored or rewritten or erased in the corresponding channel depending upon the state of the key. The main portion 21 also produces, in time shared sequence, a claim signal CLM representing that a key corresponding to a key code signal KC stored in a particular channel is being depressed and a release signal RLS representing that a key in a particular channel is released and the channel is empty.

The key code signals KC of the respective channels are sequentially supplied to a synchronizing circuit 22. The synchronizing circuit 22 is provided for sequentially supplying the key code signals KC of the respective channels to a decoder 23 in synchronization with channel clock $\phi_{CH}$. The key code signal KC for representing each of the 61 keys consists of binary data of 6 bits.

The decoder 23 is a 6-bit-binary to 61-individual converter and produces an output corresponding to the applied key code signal and the respective outputs of the decoder 23 constitute the key gate control signals $N_1 - N_{61}$. Accordingly, the key gate control signals $N_1 - N_{61}$ corresponding to the respective channels are produced in time shared sequence in synchronization with the channel clock $\phi_{CH}$. No key code KC is generated for an undepressed key and key gate control signals corresponding only to depressed keys are generated among the key gate control signals $N_1 - N_{61}$.

A channel counter 24 counts channel clock $\phi_{CH}$ and generates binary code outputs of 3 bits correspnding to the eight channels. A decoder 25 is a 3-bit-binary to 8-individual converter and sequentially provides outputs on its eight output lines in synchronization with the channel clock $\phi_{CH}$. These outputs constitute channel gate control signals $H_1 - H_8$ for the eight channels. The channel gate control signals $H_1 - H_8$ are produced sequentially and circulatingly in time sharing manner. Accordingly, the key gate control signals $N_1 - N_{61}$ are produced in synchronization with the channel gate control signals $H_1 - H_8$.

Figure 8:
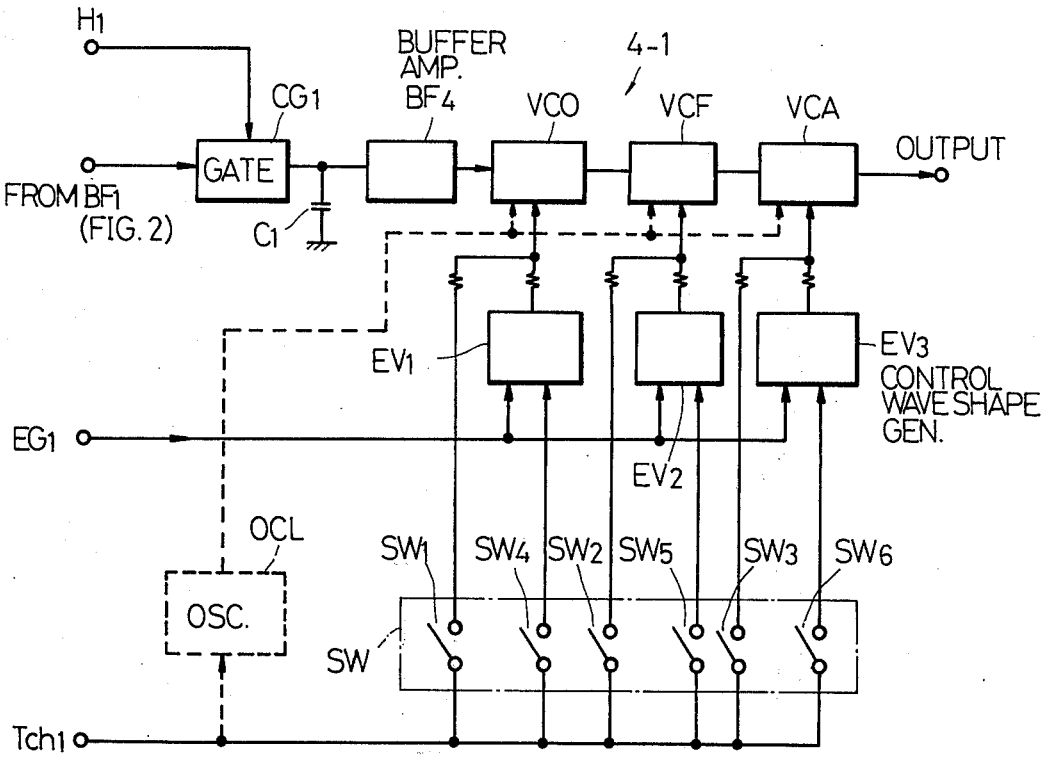
FIG. 8 is a block diagram showing an example of a musical tone signal generation system.

The pulse interval of the channel clock $\phi_{CH}$ is determined in consideration of the operation time of each analog circuit provided for sampling the note voltage, particularly the charging time of note voltage holding condensers $C_1 - C_8$ in the musical tone signal generation systems 4 – 1 through 4 – 8 (FIG. 8). In view of such operation time, the speed of the clock $\phi_{CH}$ must be a much slower one than that of a high speed clock generally used in a digital system.

If, for example, states of the respective key switches are detected in the keyboard circuit 1 by high speed scanning by a high speed clock and the time shared key code signals are produced from the main portion 21 of the key assigner at the same clock rate, the synchronizing circuit 22 is constructed in such a manner that it will provide the time shared key code signals after converting them from signals with an interval corresponding to the high rate clock to low rate signals corresponding to the channel clock $\phi_{CH}$. If the time shared key code signals are delivered by the main portion 21 of the key assigner at a low rate corresponding to the clock $\phi_{CH}$, the synchronizing circuit 22 may be simply constructed of a shift register so that key code sinals for the respective channels are sequentially shifted and delivered out by the clock $\phi_{CH}$.

FIG. 4*a* is a timing chart showing channel gate control signals $H_1 - H_8$. The gate control signals $H_1 - H_8$ of a low level have a pulse width of 1 ms in the present embodiment. FIG. 4*b* is a timing chart showing that seven key gate control signals $N_1$ (representing the note $C_7$) through $N_5$ (corresponding to $C_6^{sharp}$), $N_{50}$ (corresponding to $B_2$) and $N_{61}$ (corresponding to $C_2$) are produced in synchronization with the channel gate control signals $H_1$ through $H_7$. In this example, no key gate control signal is produced in the eighth channel (synchronous with the signal $H_8$).

The claim signal CLM and the release signal RLS are applied to an envelope gate control signal generation circuit 26 where static envelope gate control signals $EG_1 - EG_8$ indicating that a key is depressed in a particular channel are generated. This circuit 26 consists, for example, of a latch circuit which sequentially latches the claim signal CLM or the release signal RLS in synchronization with its time sharing period for producing static information. These control signals $EG_1 - EG_8$ are suitably used in various control operations as signals indicating depression of keys.

Reverting now to FIG. 1, an essential part of the invention will now be described. In FIG. 1, transducers $T_1 - T_{61}$ are provided for converting finger touch on the keys to electric signals. One such transducer is provided for each of the keys in a suitable place such as under the keyboard. Any type of transducer may be employed as the transducers $T_1 - T_{61}$ if it can sufficiently detect the pressure etc. applied by the finger touch. For example, a pressure-voltage conversion element capable of detecting the pressure, a device for detecting speed of depression or a device for detecting displacement in depression (used for touch vibrato) may be advantageously employed as the transducer. In the present embodiment, a pressure-voltage conversion element is used as the transducer.

Figure 5:
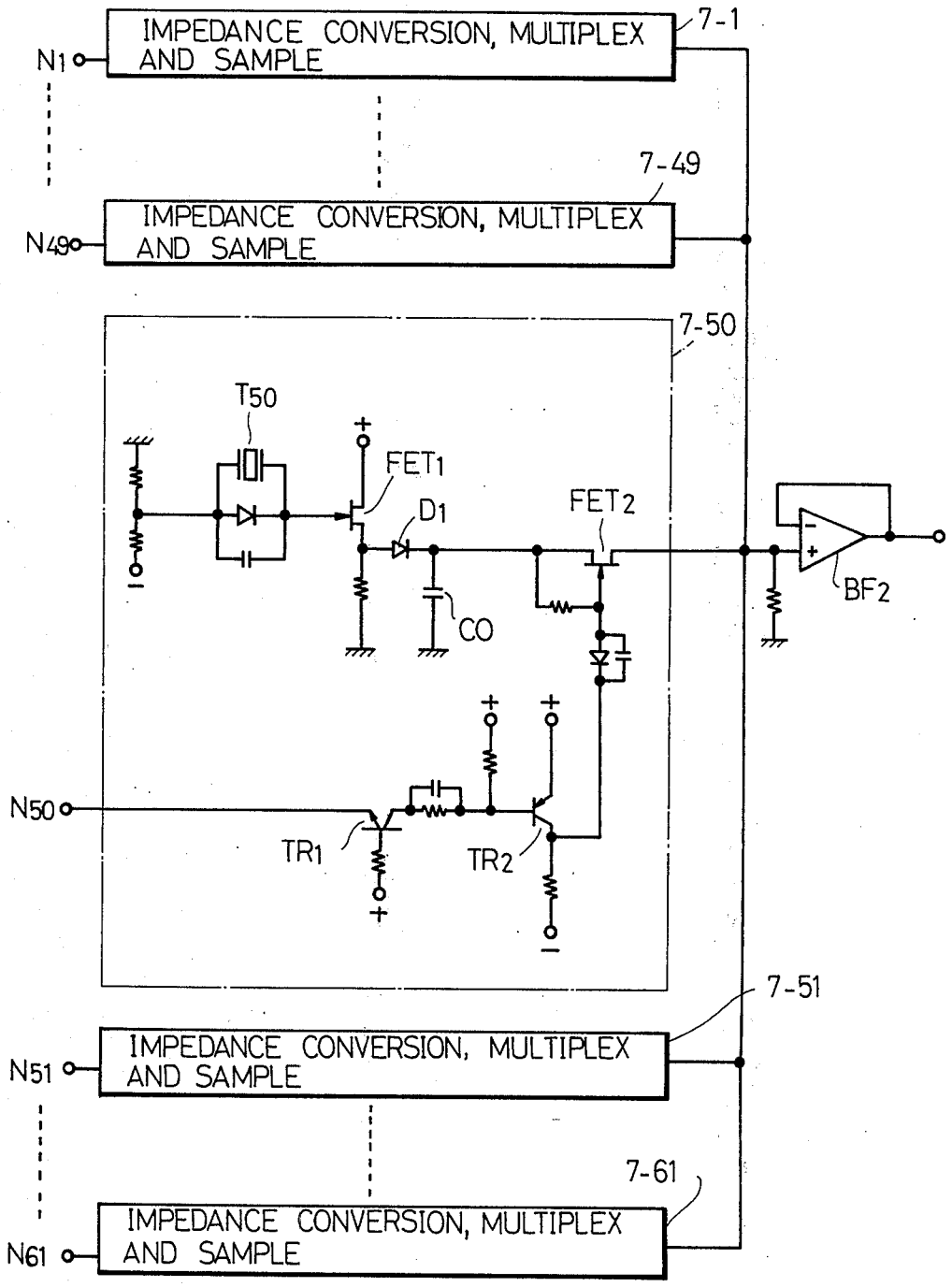
FIG. 5 is a circuit diagram showing an example of an impedance conversion and time sharing multiplexing circuit.

An impedance conversion and time sharing multiplexing sampling circuit 7 converts impedance of detection signals produced by the transducers $T_1 - T_{61}$ and thereafter samples the detection signals in time sharing with a timing of the key gate control signals $N_1 - N_{61}$. As specifically shown in FIG. 5, impedance conversion and time sharing multiplexing sampling circuits 7 – 1 through 7 – 61 are provided one for each key and incorporate the transducers $T_1 - T_{61}$ corresponding to the respective keys. Only the circuit 7 – 50 is illustrated in detail and it should be noted that the other circuits are of the same construction.

The pressure-voltage conversion elements used as the transducers $T_1 - T_{61}$ have a sharp response to the attack characteristic produced upon depression of the keys. Accordingly, the transducers produce a high peak voltage with a sharp rise at the instant of depression of a key (i.e., key-on time). This analog type detection signal produced by the transducers is applied to a field-effect transistor FET 1 of a high input impedance in which the impedance change takes place.

The detection signal is held for a relatively long period of time since the pressure-voltage conversion element has electrostatic capacity for several nF. The detection signal (voltage) has a magnitude corresponding to the pressure applied by depression of the key. This detection signal is applied through a diode $D_1$ to a condenser CO and held therein.

As shown in FIG. 4*b*, the key gate control signals $N_1 - N_{61}$ generated in time sharing in each channel time are applied also to the corresponding circuits 7 – 1 through 7 – 61. When, for example, the key gate control gate $N_{50}$ is generated in the channel time of the sixth channel, the low level signal $N_{50}$ causes a transistor $TR_1$ to turn ON which in turn causes a transistor $TR_2$ to conduct thereby supplying a suitable gate control signal to a field-effect transistor $FET_2$. The impedance-converted detection signals are sampled by the field-effect transistor FET 2 and thereafter are provided as output signals through a buffer amplifier $BF_2$. In this manner, the detection signals are sampled in time sharing manner in the respective circuits 7 – 1 through 7 – 6 in response to the key gate control signals $N_1 - N_{61}$ and the time sharing multiplexed detection signals are produced from the buffer amplifier $BF_2$.

The time sharing multiplexed detection signals are applied to a touch signal generation circuit 8 which these signals are converted into static touch signals for the respective channels. In the present embodiment, the circuit 8 includes a suitable time constant circuit for producing a waveshape used for an after-touch control purpose. There are provided touch signal generation circuits 8 – 1 through 8 – 8 corresponding to the respective channels, one of such circuits being shown in detail in FIG. 6. The time sharing multiplexed detection signals provided from the buffer amplifier $BF_2$ (FIG. 5) are applied to a terminal $t_1$ and supplied to the respective circuits 8 – 1 through 8 – 8. These detection signals are applied to a condenser $CO_1$ through a diode $D_2$ and a field-effect transistor FET 3. The channel gate control signals $H_1 - H_8$ and the envelope gate control signals $EG_1 - EG_8$ are applied to the corresponding circuits 8 – 1 through 8 – 8. When the low level channel gate control signal $H_1$ is produced with timing as shown in FIG. 4*a*, the transistor $TR_3$ becomes OFF and voltage at the gate of the field-effect transistor $FET_3$ relatively rises thereby causing the transistor FET 3 to conduct. The field-effect transistors in the other circuits 8 – 2 through 8 – 8 likewise become ON with timing of the signals $H_2 - H_8$. Accordingly, the sampling operation in the sampling circuit 7 in a particular channel time is completely synchronized with the gate control operation by the field-effect transistor FET 3 in the corresponding circuit among the circuits 8 – 1 through 8 – 8. Accordingly, the condenser $CO_1$ is charged with a detection signal of a sole key corresponding to the first channel (i.e., the key for the note $C_7$ in the example of FIG. 4*b*. The voltage charged in the condenser $CO_1$ is a first peak voltage of the detection signal, i.e., voltage of attack characteristic.

In the foregoing manner, touch detection signals for the respective keys are multiplexed in time sharing by the same number as the maximum number of tones to be produced simultaneously and thereafter sequentially charged in the condensers of the respective circuits 8 – 1 through 8 – 8 in time shared synchronization to produce static touch signals which are distributed parallelly to the respective channels. The voltages (i.e., touch signals) of the condenser $CO_1$ are provided as touch signals $Tch_1 - Tch_8$ through a buffer samplifier $BF_3$ of a high impedance and an amplifier $VCA_1$ which is capable of gain controlling.

Figure 7:
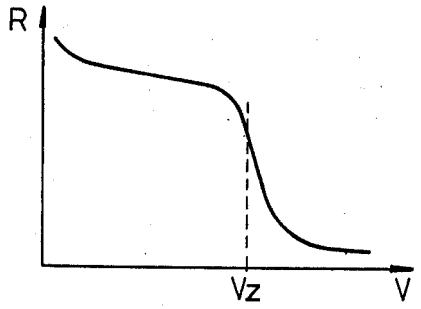
FIG. 7*a* is a graphic diagram showing a preferred characteristic of a diode element used in a touch signal generation circuit.
FIG. 7*b* is a graphic diagram showing a waveshape of the touch signal.
Figure 7:
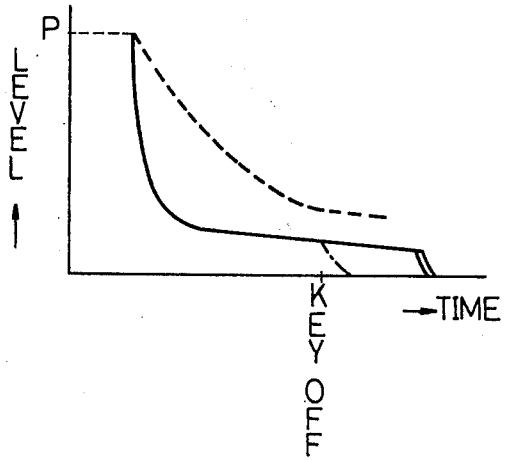

For providing "after touch control," the touch signal generation circuit 8 comprises a discharging circuit including a photo-coupler PC, a diode element DG and a field-effect transistor FET 4. The diode element DG has the characteristic of a breakdown or Zener diode (i.e., a characteristic as shown in FIG. 7*a* in which resistance R rapidly drops as voltage V exceeds a value Vz) to obtain an attenuation characteristic with a sharp peak and a long sustain state as shown in FIG. 7*b*. In FIG. 7*b*, the peak P of the waveshape (touch signal) is composed of the first peak voltage charged in the condenser $CO_1$, i.e., the touch detection signal of attack characteristic. By attaching an attenuation characteristic as shown in FIG. 7*b* to this peak voltage, an after-touch control corresponding to the degree of touch can be obtained.

The voltage charged in the condenser $CO_1$ is discharged through the transistor FET 3, resistance $R_1$ of the photocoupler PC, the diode element DG and resistance $R_2$ with timing of the time sharing gate control by the transistor FET 3. The attenuation characteristic as shown in FIG. 7*b* is produced due to the above described characteristic of the diode element DG. Light emission diodes LED of the photo couplers PC in the circuits 8 – 1 through 8 – 8 are connected in series with each other and current corresponding to the magnitude of the voltage applied to the base of a transistor $TR_4$ flows through a transistor $TR_5$ and the light emission diodes LED. Accordingly, the value of the resistance $R_1$ can be variably controlled. This resistance $R_1$ determines sharpness of the attack characteristic. The value of the resistance $R_1$ is so small when compared with a value of resistance during conduction of the diode element DG (i.e., value of resistance R below voltage Vz) that it affects only the attenuation immediately follwing the attack (during conduction of the element DG). Accordingly, if the resistance $R_1$ is large, attack is relatively gradual as shown by the dotted line in FIG. 7*b* whereas attack is sharp as shown by the solid line in FIG. 7*b* is $R_1$ is small.

Figure 6:
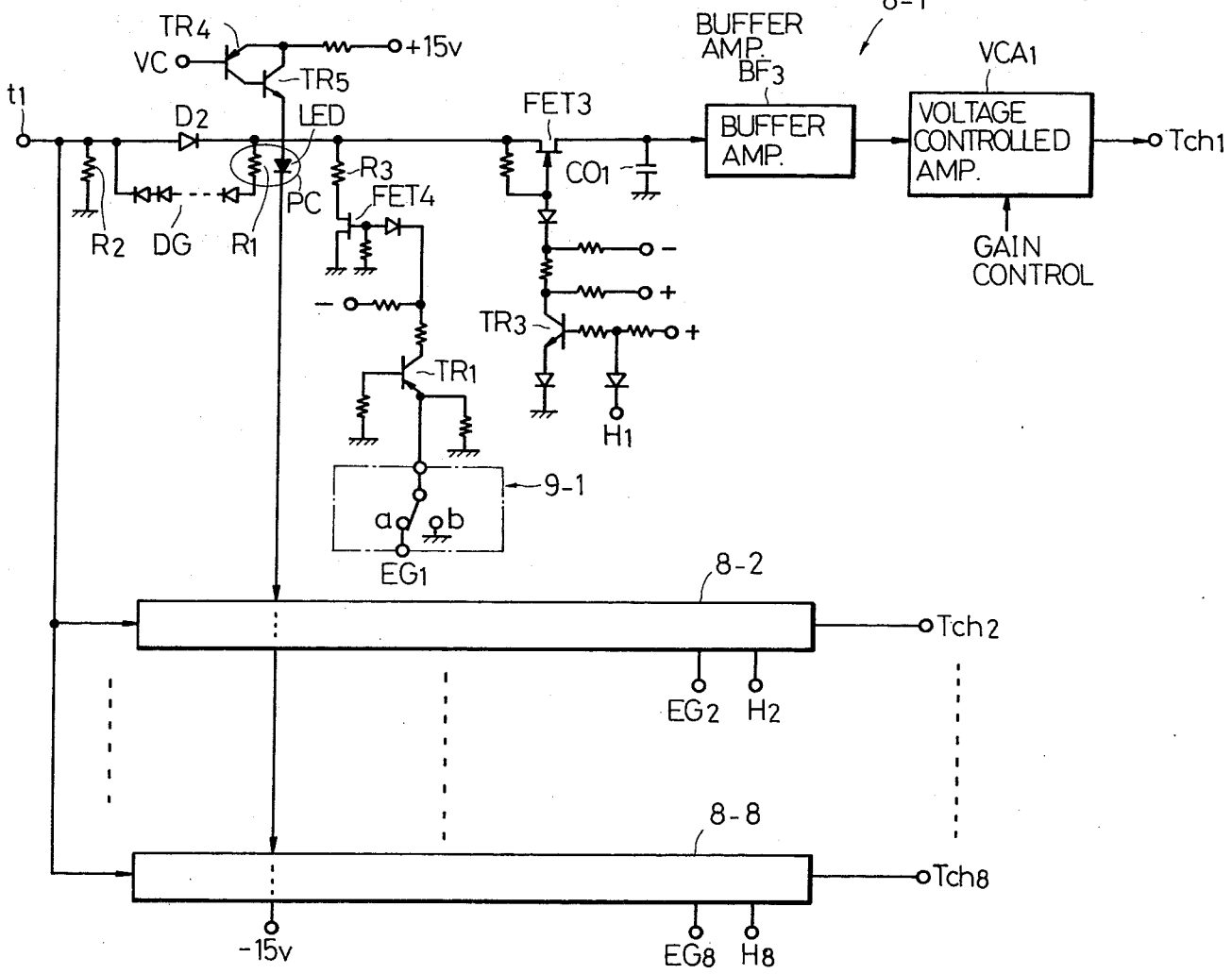
FIG. 6 is a circuit diagram showing an example of a touch signal generation circuit.

Conduction and non-conduction of a field-effect transistor FET 4 is controlled by a relay contact 9 – 1. A relay transfer circuit 9 shown in FIG. 1 comprises relay switches 9 – 1 through 9 – 8 for the respective channels and relay coils (not shown) for actuating these relay switches. These relay coils are driven by a damper pedal (not shown) operated by a player. The relay switches 9 – 1 through 9 – 8 are incorporated in the circuits 8 – 1 through 8 – 8 as shown in FIG. 6 and, in one state of actuation, provide the discharging circuits with sub discharging circuit portions capable of reducing the discharging time constant upon key release.

The envelope gate control signald $EG_1 - EG_8$ which are produced by the key assigner 2 are applied to contact *a* of the relay switches 9 – 1 through 9 – 8. The relay switches are in contacts with the contacts *a* when the damper pedal is not depressed. Contacts *b* of the relay switches 9 – 1 through 9 – 8 are grounded and the relay switches are switched to the contacts *b* when the damper pedal is depressed. This brings a transistor $TR_7$ out of conduction and thereby causes the transistor FET4 to become OFF. If a key is depressed with the switch 9 – 1 at the contact *a* (i.e., while the damper pedal is not depressed), the low level envelope gate control signal $EG_1$ is applied and the transistors $TR_7$ and FET4 become OFF. This causes the detection signal from the transducer $T_1$ to be charged in the condenser $CO_1$. Discharging from the condenser $CO_1$ is made through the transistor $FET_3$, resistance $R_1$ of the photo coupler PC, diode element DG and resistance $R_2$ with a result that sustain as shown by a solid line in FIG. 7*b* is produced. When the key is released, the level of the signal $EG_1$(key-off signal) rises so that the transistors $TR_7$ and FET4 conduct and the charged voltage of the condenser $CO_1$ is instantaneously discharged through resistance $R_3$ and transistor FET4 (having a small time constant) resulting in production of an abrupt decay as shown by a chain and dot line in FIG. 7*b*.

If the switch 9 – 1 is at the contact *b* (i.e., the damper pedal is depressed), the transistors $TR_7$ and FET4 are OFF regardless of operation of the key so that the charged voltage of the condenser $CO_1$ is discharged only through the transistor FET3, resistance $R_1$ of the photo coupler PC, diode element DG and resistance $R_2$. In this case, the sustain shown by the solid line in FIG. 7*b* is obtained even when the key is released. If the damper pedal is released, the switch 9 – 1 is switched to the contact *b* position and a rapid decay as shown by parallel solid lines in FIG. 7*b* is obtained. Accordingly, the rapid decay can be started at a desired position in the envelope.

Various after-touch controls can be provided by producing waveshapes for after-touch control purposes in the foregoing manner. The touch signals $Tch_1$ – $Tch_8$ for the respective channels are applied to the musical tone signal generation systems 4 – 1 through 4 – 8 for various touch control purposes with respect to the note, tone color and volume of the musical tone.

FIG. 8 shows the construction of the musical tone signal generation system 4 – 1. It will be noted that the other systems 4 – 2 through 4 – 8 are of the same construction as the system 4 – 1. The systems 4 – 1 through 4 – 8 respectively comprise channel gate circuit $CG_1$ – $CG_8$ and note voltage holding condensers $C_1$ – $C_8$. The input terminals of the channel gate circuits $CG_1$ – $CG_8$ are connected in common to the output terminal of the buffer amplifier $BF_1$ (FIG. 2). The gate circuits $CG_1$ – $CG_8$ conduct upon receipt of the corresponding channel gate control signals $H_1$ – $H_8$ enabling the sampled note voltages produced from the buffer amplifier $BF_1$ to be sampled through these gate circuits $CG_1$ – $CG_8$. The gate circuits $CG_1$ – $CG_8$ respectively correspond to the channels of plural tones to be reproduced simultaneously.

Condensers $C_1$ – $C_8$ are provided on the output side of the gate circuits $CG_1$ – $CG_8$ for holding the sampled note voltages. The gate control signals $H_1$ – $H_8$ are applied to the gate circuits $CG_1$ – $CG_8$ during a predetermined period of time required for charging the condensers $C_1$– $C_8$. Alternatively stated, the gate control signals $H_1$ – $H_8$ are pulse signals each having a pulse width of this predetermined period of time.

Figure 9:
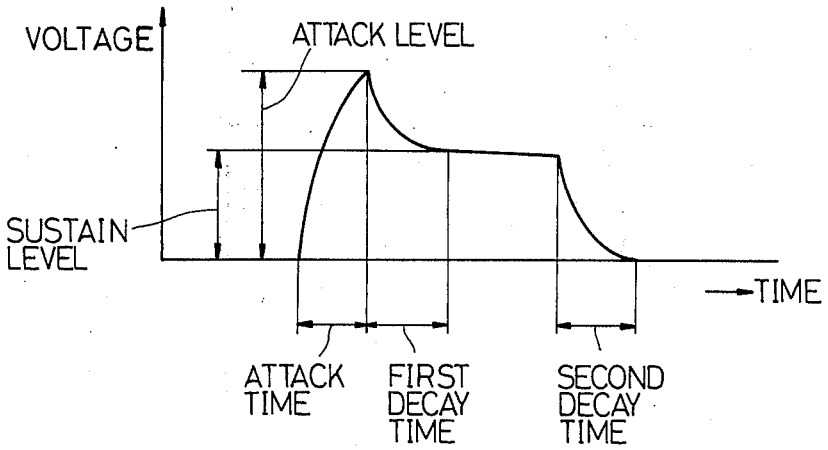
FIG. 9 is a graphic diagram showing an example of a control voltage waveshape.

The gate control signals $H_1$ – $H_8$ are sequentially applied to the respective gate circuits $CG_1$ – $CG_8$ during this period of time thereby enabling the gate circuits $CG_1$ – $CG_8$ in time shared sequence. As the gate circuits $CG_1$ – $CG_8$ are sequentially enabled, the note voltages having been sampled in the circuit shown in FIG. 2 are sequentially charged in the condensers $C_1$ – $C_8$ and held therein. As has previously been described, the key gate control signals $N_1$ – $N_{61}$ are applied in synchronization with the channel gate control signals $H_1$ – $H_8$. When, for example, the gate control signal $H_1$ is applied to the channel gate circuit $CG_1$, a sole key gate control signal is applied to a corresponding one of the key gate circuits causing a note voltage to be sampled from a corresponding resistance element top the circuit 3 in FIG. 4) and thereafter charged and held in the condenser $C_1$. The terminal voltage of the condenser $C_1$ (note voltage) is applied to a voltage-controlled oscillator VCO through a buffer amplifier $BF_4$ of a high input impedance for generation of a frequency signal corresponding to the note voltage. The pitch is controlled in accordance with the waveshape of the control voltage. The signal is then applied to a voltage-controlled filter VCF and a voltage-controlled amplifier VCA for control of the tone color and volume. Control waveshape generators $EV_1$, $EV_2$, $EV_3$ are provided for the respective voltage-controlled type devices VCO, VCF and VCA. The generators $EV_1$ – $EV_3$ supply a control voltage waveshape as shown in FIG. 9 to the control voltage input terminals of the devices VCO, VCF and VCA. This control voltage waveshape is produced on the basis of the envelope gate control signal $EG_1$ (in the other systems, $EG_2$ – $EG_8$) provided by the key assigner 2. In the respective generators $EV_1$ – $EV_3$, levels and time lengths of the envelope as shown in FIG. 9 can be separately selected.

The touch signal $Tch_1$ ($Tch_2$ – $Tch_8$) produced from the touch signal generation circuit 8 is selectively applied through a switch SW to the control waveshape generators $EV_1$ – $EV_3$, or the control voltage input of the oscillator VCO, filter VCF or amplifier VCA. If switches $SW_1$ – $SW_3$ are switched ON, the touch signals are applied directly to the devices VCO, VCF and VCA and the note, tone color and volume are controlled in accordance with the voltage waveshape shown in FIG. 7*b*. If switches $SW_4$ – $SW_6$ are switched ON, the touch signals are applied to the generators $EV_1$ – $EV_3$ in which these signals are used for controlling desired parameters such as levels and time lengths of the control voltage shown in FIG. 9. More specifically, the magnitude of level elements such as the attack level and the sustain level which constitute the envelope shown in FIG. 9 are controlled in accordance with the voltage waveshape of the touch signal shown in FIG. 7*b*. Further, time lengths such as the attack time, first decay time and second decay time in FIG. 9 are also controlled by the voltage waveshape of the touch signal. Thus, the control voltage waveshape is formed in response to the touch signal in the generators $EV_1$ – $EV_3$.

If, as shown by a broken line in FIG. 8, the touch signal $Tch_1$ is applied to the oscillator OCL and the frequency and amplitude of an oscillated frequency signal are variably controlled in accordance with the voltage waveshape of the touch signal before the frequency signal is applied to the devices VCO, VCF and VCA, a vibrato or mandolin modulation corresponding to the touch may be applied to a normal tone of the reproduced musical tone.

The above description has been made with respect to the example in which the invention is applied to a music synthesizer capable of producing plural tones simultaneously. It should be noted however, that the invention may also be applied to other types of electronic musical instruments capable of producing plural tones simultaneously by digital time division processing of information. In summary, electronic musical instruments in which a touch detection signal is sampled in a time sharing manner in synchronization with time sharing processing for production of a musical tone and in which the sampled signal is held by each channel for utilization for various control of the musical tone fall within the scope of the invention. The analog signal which is statically converted and held for each channel may be converted to a digital signal for subsequent utilization for control purposes.

What is claimed is:

1. An electronic musical instrument capable of time-shared multiplexing of information identifying a plurality of depressed keys by respective channels equal in number to a maximum number of musical tones to be simultaneously played which is substantially smaller than the number of tones that can otherwise be played, and producing and simultaneously playing musical tones corresponding to the depressed keys in response to the multiplexed information, said instrument comprising:

a. transducers for detecting a characteristic of the finger touch applied to each key upon depression thereof and producing a touch detection signal in accordance therewith;

b. a circuit for sampling, by each corresponding key, the touch detection signals for the respective keys produced by said transducers, the sampling being in synchronization with said time-shared multiplexing of the depressed key information and being such that the sampled touch detection signals themselves are multiplexed in a time-sharing manner;

c. a touch signal generation circuit, including capacitors for storing the time-shared multiplexed touch detection signals by each channel and discharging circuits for said capacitors, for delivering out voltages at one terminal of said capacitors as touch signals; and d. a musical tone signal generation system including control means for controlling at least one parameter among the pitch, tone color and volume parameters of the musical tones corresponding to the depressed keys in accordance with said touch signals, whereby touch control is realized for each tone of the maximum number of tones to be simultaneously played.

2. An electronic musical instrument as defined in claim 1 in which each said discharging circuit comprises at least one element which has a characteristic such that its resistance drops sharply when applied voltage thereto has exceeded a certain value whereby a touch signal with sharp attack and decay followed by a long sustain is obtained.

3. An electronic musical instrument as defined in claim 1 in which each said discharging circuit has a sub discharging circuit portion capable of reducing the discharging time constant upon release of the key by selection of switches.

4. An electronic musical instrument as defined in claim 3 which further comprises control means which receive signals representing key-on and key-off among said time shared multiplexed information and cause said sub discharging circuit to conduct in response only to the key-off signal thereby to produce a touch signal which decays sharply upon receipt of the key-off signal.

5. An electronic musical instrument as defined in claim 1 in which said musical tone signal generation system comprises a voltage-controlled oscillator receiving note information of the depressed key, a voltage variable filter connected to the output side of said voltage-controlled oscillator, a voltage-controlled amplifier connected to the output side of said voltage variable filter and switches for selectively applying said touch signal to said voltage-controlled oscillator, voltage variable filter and voltage-controlled amplifier.

6. An electronic musical instrument as defined in claim 1 wherein said musical tone signal generation system comprises a voltage-controlled oscillator receiving note information of the depressed key, a voltage variable filter connected to the output side of said voltage-controlled oscillator, a voltage-controlled amplifier connected to the output side of said voltage variable filter, an oscillator for producing a signal having a frequency corresponding to said touch signal and means for applying the output of said last-mentioned oscillator to a control terminal of a desired one among said voltage-controlled oscillator, voltage variable filter and voltage-controlled amplifier.

* * * * *